United States Patent [19]

Tenconi

[11] Patent Number: 5,000,014

[45] Date of Patent: Mar. 19, 1991

[54] NEEDLE SELECTION DEVICE FOR CIRCULAR KNITTING MACHINES

[75] Inventor: Riccardo Tenconi, Varese, Italy

[73] Assignee: MEC-MOR S.r.l., Induno Olona, Italy

[21] Appl. No.: 307,039

[22] Filed: Feb. 6, 1989

[30] Foreign Application Priority Data

Feb. 15, 1988 [IT] Italy ..... 19409 A/88
Nov. 8, 1988 [IT] Italy ..... 22554 A/88

[51] Int. Cl.[5] ..... D04B 15/78
[52] U.S. Cl. ..... 66/219; 66/225
[58] Field of Search ..... 66/219, 221, 222, 224, 66/225

[56] References Cited

U.S. PATENT DOCUMENTS

| | | | |
|---|---|---|---|
| 3,811,297 | 5/1974 | Hamma | 66/222 X |
| 3,998,073 | 12/1976 | Luth | 66/221 |
| 4,036,033 | 7/1977 | Jesson | 66/225 X |
| 4,038,837 | 8/1977 | Güell | 66/219 |
| 4,138,865 | 2/1979 | Lüth | 66/219 |

FOREIGN PATENT DOCUMENTS

| | | | |
|---|---|---|---|
| 3002538 | 8/1980 | Fed. Rep. of Germany | 66/219 |
| 483511 | 2/1970 | Switzerland | 66/219 |

*Primary Examiner*—Wm. Carter Reynolds
*Attorney, Agent, or Firm*—Guido Modiano; Albert Josif

[57] ABSTRACT

The device includes at least one selection lever, one end whereof is arranged laterally facing the needle cylinder at the level of a heel of selection elements accommodated in the grooves of the needle cylinder below the selectors or sub-needles. The selection lever is movable towards or away from the needle cylinder from a first position, in which its end engages the heel of the selection elements, to a second position in which it does not interfere with said heel. The end of the selection lever has a rising portion which in the first position raises the selection element when the needle cylinder rotates with respect to the selection lever. As an effect of this lifting, the overlying selector is engaged by a lifting cam arranged facing the needle cylinder so that the overlying needle is moved to knit.

40 Claims, 4 Drawing Sheets

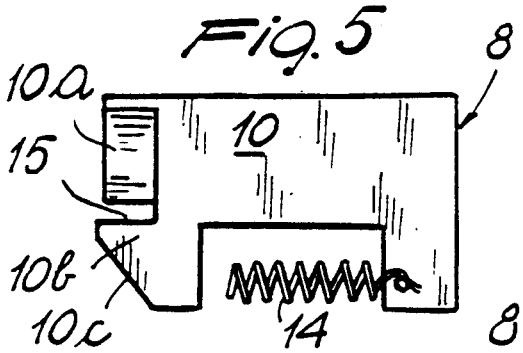
Fig. 5
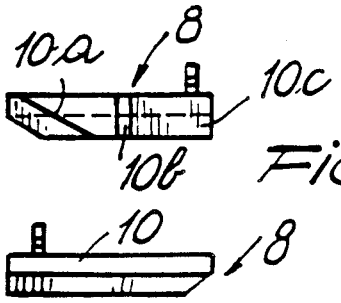
Fig. 7
Fig. 8
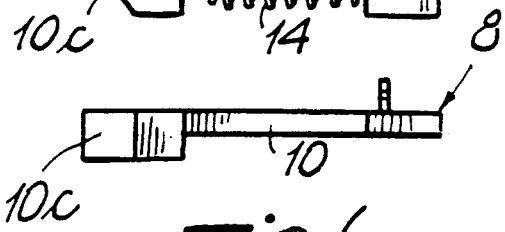
Fig. 6
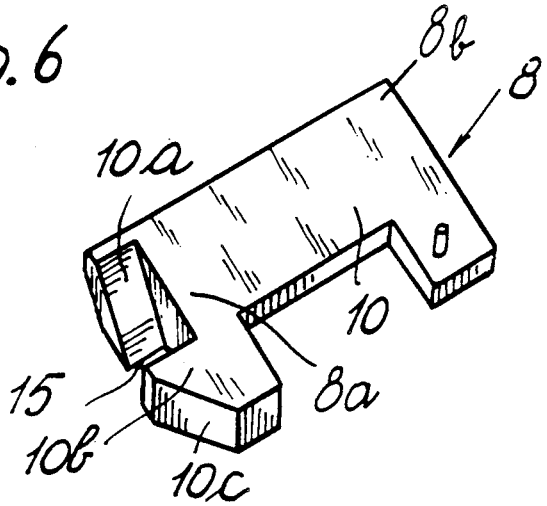
Fig. 4
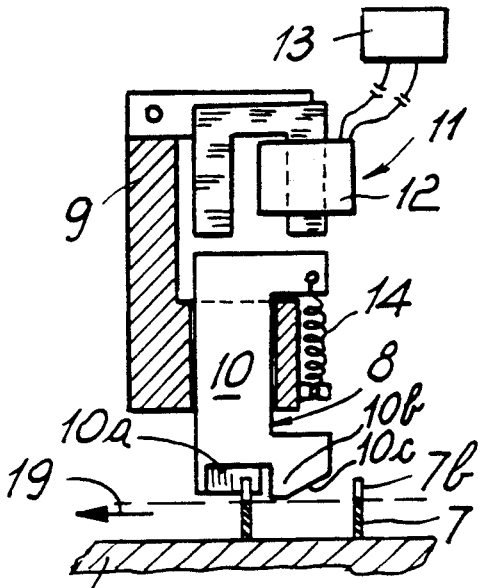
Fig. 9
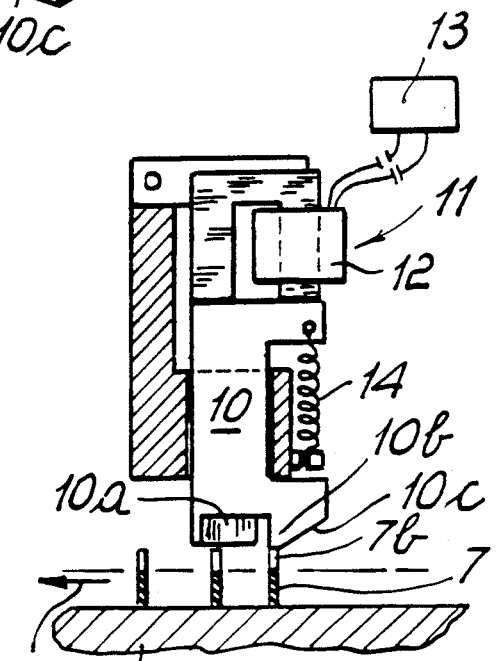
Fig. 10

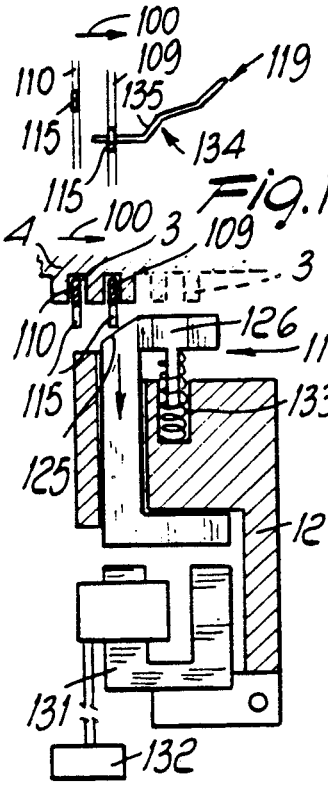
Fig. 14
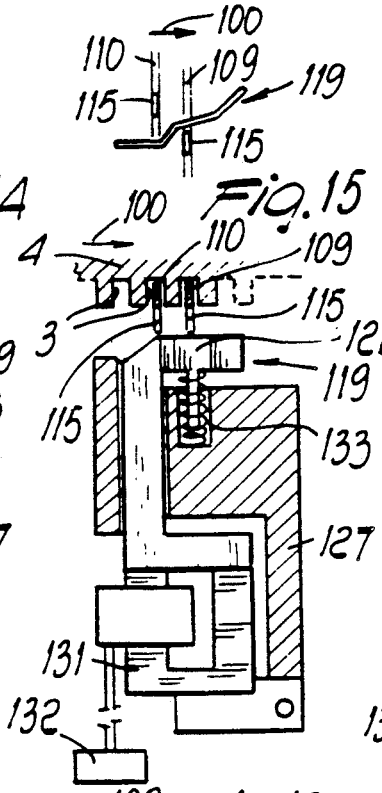
Fig. 15
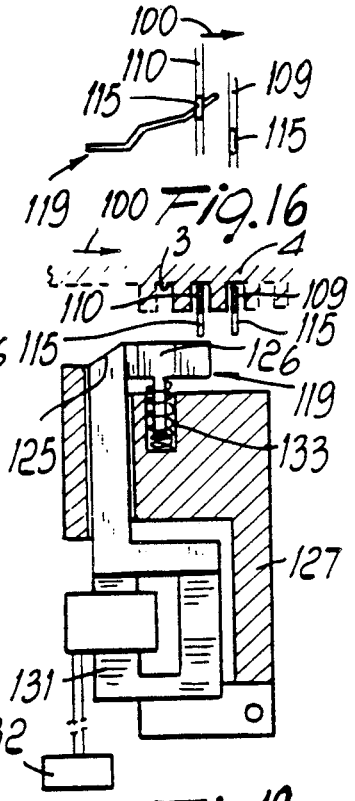
Fig. 16
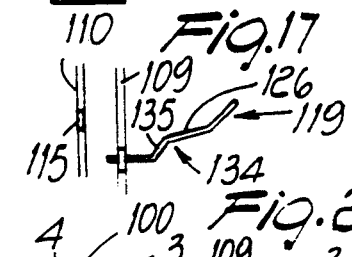
Fig. 17
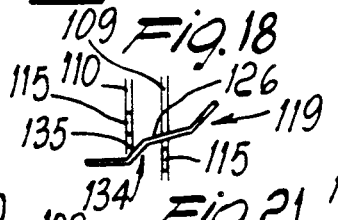
Fig. 18
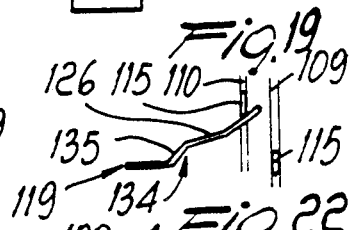
Fig. 19
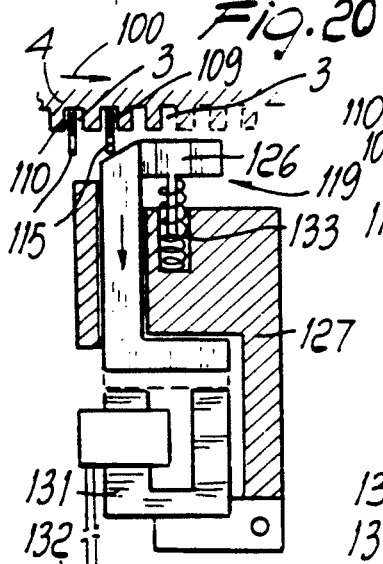
Fig. 20
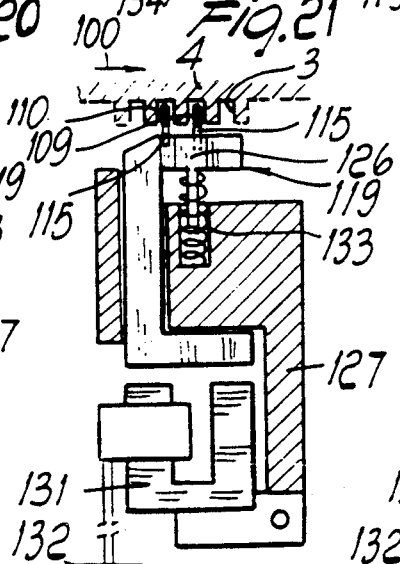
Fig. 21
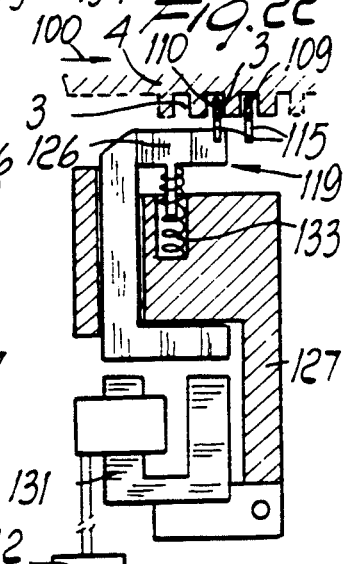
Fig. 22
Fig. 23
Fig. 24
Fig. 25

NEEDLE SELECTION DEVICE FOR CIRCULAR KNITTING MACHINES

BACKGROUND OF THE INVENTION

The present invention relates to a needle selection device for circular knitting machines.

As known, circular knitting machines comprise a needle cylinder with a skirt in which a plurality of grooves is defined; said grooves extend parallel to the axis of said skirt, and each accommodates a needle and a selector or subneedle. When forming stitches of knitting, the needles are actuated with an alternating motion along their related grooves by means of cams, arranged around the needle cylinder which engage with a needle heel protruding radially from the grooves, and which, upon rotation of the needle cylinder about its own axis relatively to said cams, cause this alternating motion. In order to determine which needles must knit, according to the various knitting requirements, selection devices are used which act on the selectors so as to engage or prevent the engagement of a main heel thereof with a lifting cam which, if it engages said main heel, moves the selector to act on the overlying needle to engage its heel in a preset path defined by the related cams for causing it to knit.

Selectors generally have, below their main heel, one or more selection heels located at different heights. The selectors are accommodated in the related grooves of the needle cylinder and can oscillate in a radial plane towards or away from the axis of the needle cylinder so as to pass from an inoperative position, in which their main heel is completelY inserted into the related groove of the needle cylinder and therefore does not engage with the lifting cam when the overlying needle is to be excluded from knitting, to an operative position, in which their main heel protrudes radially from the related groove to engage with the lifting cam when the overlying needle must knit. In order to oscillate the selectors and therefore move them from their operative position to their inoperative position or vice versa, selection devices are generally used which comprise a plurality of selection levers arranged upstream cf the lifting cam, according to the direction of rotation of the needle cylinder Each selection lever has one of its ends directed towards the needle cylinder and arranged substantially at the level of one of the selection heels of the selectors, and can be controllably moved from a first position, in which it interferes with one or more selection heels to oscillate the related selectors, to a second position in which it does not interfere with the selection heels of the selectors.

The selection levers are moved from the first position to the second and vice versa by oscillating the selection levers or by moving the selection levers towards or away from the axis of the needle cylinder. In some selection devices this movement is achieved by mechanical actuation means, while in others it is achieved by electromagnets which are energized or de-energized according to the knitting program of the machine.

In any case, in order to obtain a great possibility of selection it is necessary to use selectors with a large number of selection heels, which are therefore relatively long. In the case of machines having a large number of needles per unit of length, i.e. with low-thickness selectors, the disadvantage may occur that the selectors flex longitudinally, reducing the oscillating effect imparted by the selection levers thereby causing possible errors in selecting the needles as well as breakage of the selectors. Another disadvantage related to the use of electromagnets to move the selection levers resides in the fact that in order to achieve satisfactory safety and activation speed the actuation of the electromagnets requires relatively high initial acceleration voltages, with consequent overheating and wear of the electromagnets.

SUMMARY OF THE INVENTION

The aim of the present invention is to obviate the disadvantages described above by providing a needle selection device for circular knitting machines which allows a wide possibility of selection with reduced-length selectors while their longitudinal flexing is safely avoided.

Within the scope of this aim, an object of the invention is to provide a device which can be actuated with reduced-power electromagnets, avoiding overheating problems.

Another object of the invention is to propose a device which is simple to produce with commonly available materials o and requires reduced maintenance interventions.

This aim, as well as these and other objects which will become apparent hereinafter, are achieved by a needle selection device for circular knitting machines, comprising a plurality of selectors accommodated in grooves defined in the skirt of the needle cylinder and extending parallel to the axis of said needle cylinder, each of said selectors being arranged below a needle and being controllably movable along its related groove by virtue of the action of at least one lifting cam which is arranged laterally facing the needle cylinder and is engageable, upon rotation of said needle cylinder about its axis relatively to said lifting cam, with a heel of said selectors protruding radially from a related groove, said device further comprising actuation means acting on said selectors to move them from an inoperative position, in which said heel of said selectors does not interfere with said lifting cam, to an operative position, in which said selector heel engages with said lifting cam, and vice versa, characterized in that said actuation means comprise a selection element which is accommodated below a selector in the related groove of the needle cylinder and has at least one heel protruding radially from said groove, and at least one selection lever arranged laterally facing the needle cylinder and positioned, with one of its ends, substantially at the level of said heel of said selection element, said end of said selection lever being movable towards or away from said needle cylinder from a first position, in which said end interferes with said heel of the selection element, to a second position, in which said end does not interfere with said heel of said selection element, said end of the selection lever having a rising portion engageable, in said first position, with the heel of the selection element to lift it against said selector, when the needle cylinder rotates relatively to said selection lever, in order to move said selector from said inoperative position to said operative position and vice versa.

BRIEF DESCRIPTION OF THE DRAWINGS

Further characteristics and advantages of the invention will become apparent from the description of two preferred but not exclusive embodiments of the device according to the invention, illustrated only by way of non-limitative example in the accompanying drawings, wherein:

FIGS. 1 to 10 are views of a first aspect of the device according to the invention, and more particularly:

FIGS. 1 and 2 are sectional views of a portion of the needle cylinder with a selection lever in its first position;

FIG. 3 is a schematic developed view of part of the cams acting on the needles and on the selectors and of the arrangement of a plurality of selection levers seen from the inside of the needle cylinder;

FIG. 4 is a perspective view of a selection lever according to the invention;

FIG. 5 is a top plan view of the selection lever;

FIG. 6 is a lateral elevation view of the selection lever;

FIGS. 7 and 8 are respectively front and rear elevation views of the selection lever; and FIGS. 9 and 10 are partially sectional top plan views of the selection device during operation, with the needle cylinder schematically developed;

FIGS. 11 to 25 illustrate a second aspect of the device according to the invention, and more particularly:

FIG. 11 is an enlarged perspective view of a selection lever;

FIG. 12 is a schematic, partially sectional and enlarged top plan view of a selection lever with an electromagnet for actuating it;

FIG. 13 is a schematic lateral elevation view of a portion of the needle cylinder skirt with a plurality of selection levers arranged adjacent and drawn in phantom lines;

FIGS. 14 to 16 are schematic views of the end of a selection lever and of the heels of two contiguous selection elements operating to keep a selector in its inoperative position;

FIGS. 17 to 19 are schematic and partially sectional top plan views of the selection device during the operating steps corresponding to FIGS. 14, 15 and 16;

FIGS. 20 to 22 are schematic views of the end of a selection lever and the heels of two contiguous selection elements operating to move a selector from its inoperative position to its operative position; and FIGS. 23 to 25 are schematic and partially sectional top plan views of the device according to the invention during the operating steps corresponding to FIGS. 20, 21 and 22.

DESCRIPTION OF THE PREFERRED EMBODIMENTS

Figure 1:
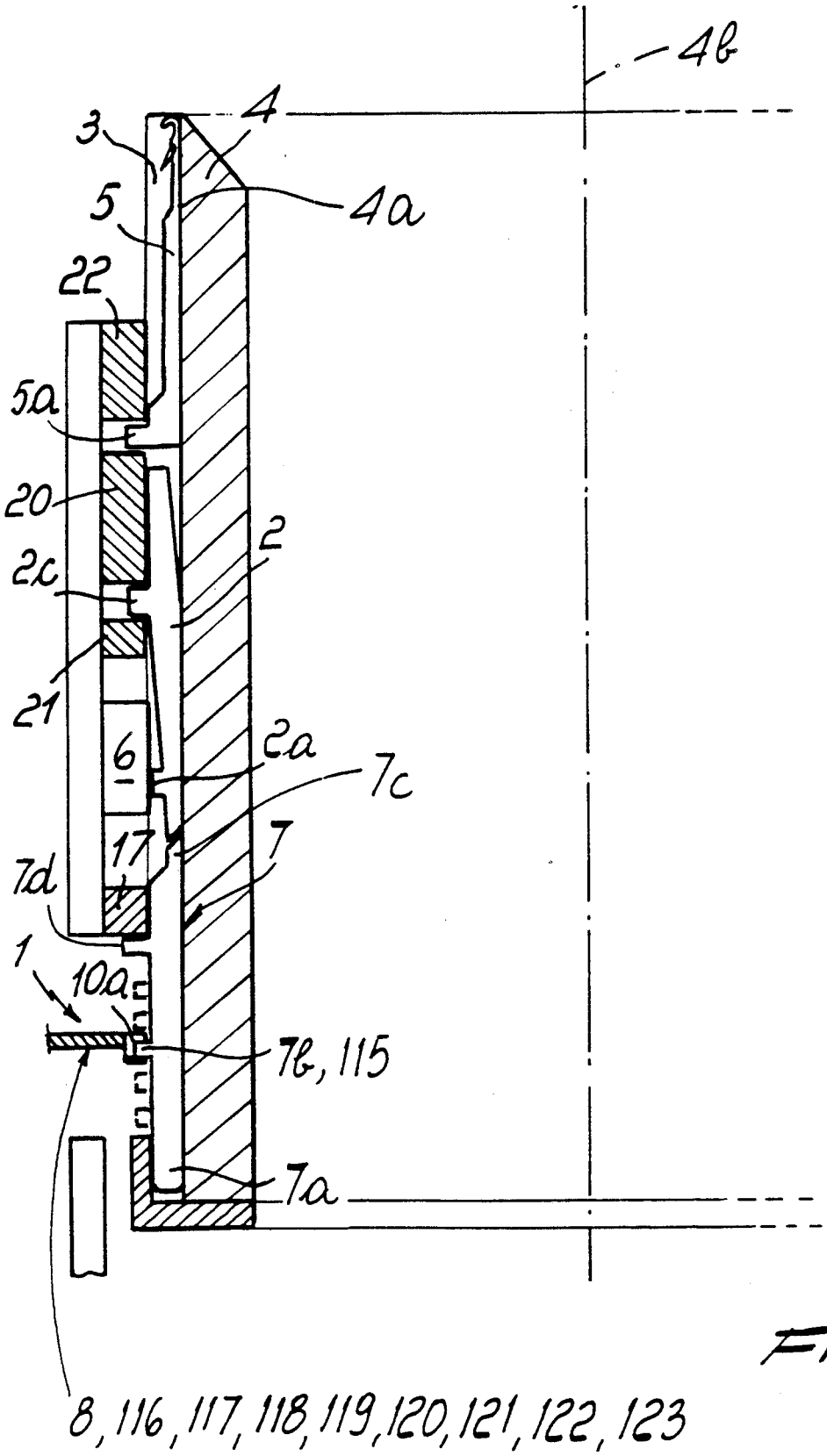
Figure 2:
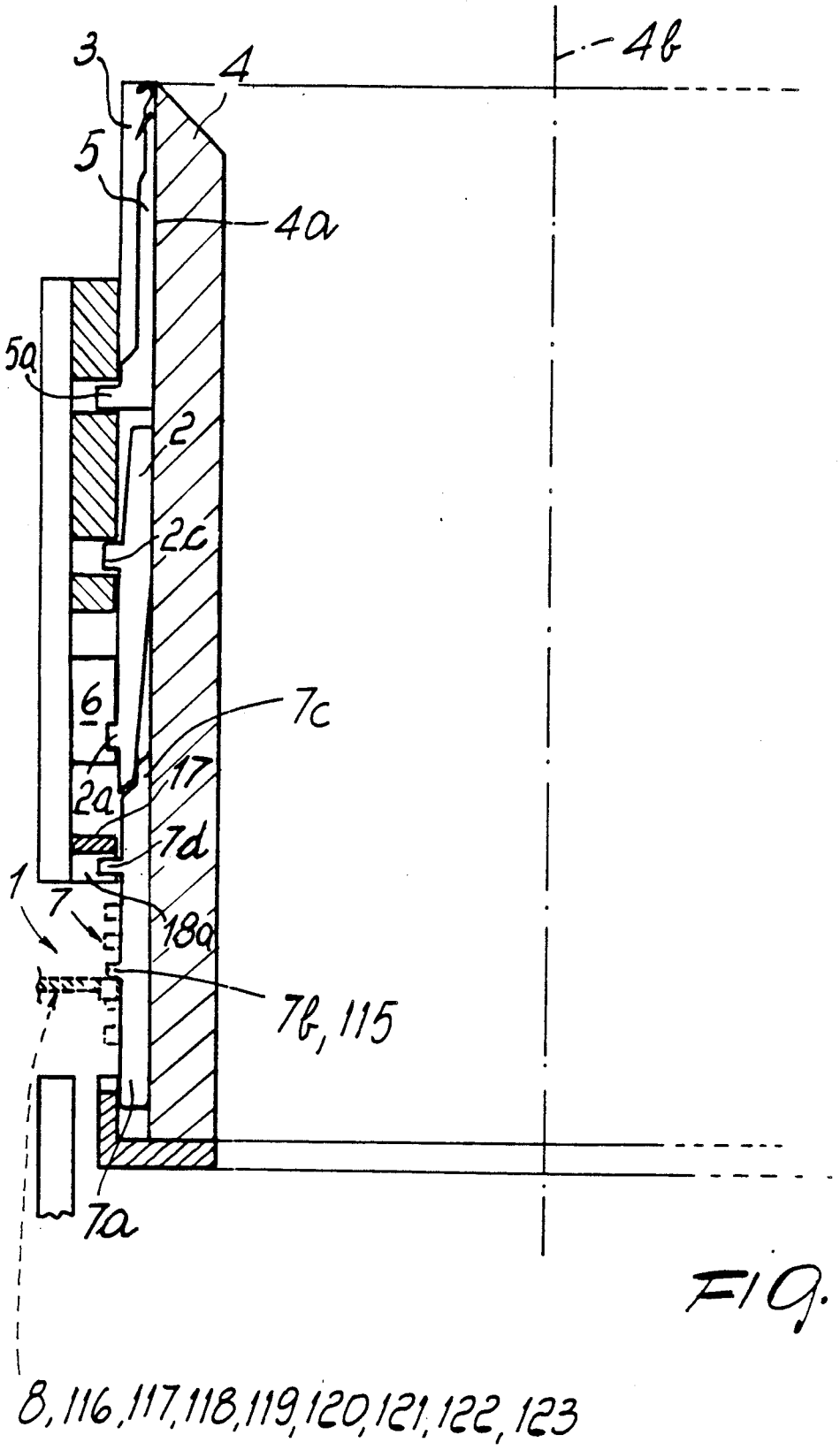

With reference to FIGS. 1 to 10, the first aspect of the device according to the invention, generally indicated by the reference numeral 1, comprises a plurality of selectors 2 or jack sub-needles, slidably accommodated in grooves 3 defined in the skirt or outer or lateral cylindrical surface 4*a* of the needle cylinder 4 parallel to the needle cylinder axis 4*b*. Each selector 2 is arranged below a needle 5 accommodated in the same groove and is oscillable in a plane which is radial with respect to the needle cylinder from an inoperative position, in which a selector heel 2*a* of said selector is inserted into the related groove 3, to an operative position, in which said selector heel 2*a* protrudes from the related groove 3. Therefore, each selector 2 is oscillable such that the select heel 2*a* moves in a direction substantially perpendicular to the cylinder axis 4*b*. Lifting cams 6 are arranged around the needle cylinder, and the heel 2*a* of the selectors engages with said cams in the operative position when the needle cylinder rotates about its axis relatively to the lifting cams 6.

According to the invention, a selection element jack 7 is accommodated below each selector in the grooves 3 of the needle cylinder and is constituted by a stem 7*a* with one or more selection element heels 7*b* which protrude radially from their related groove. At least one selection lever 8 is provided laterally of the needle cylinder 4 and its first end 89 is arranged facing the selection element heel 7*b* of the selection element 7; said selection lever is controllably movable from a first position, in which said first end interferes with the selection element heel 7*b*, to a second position, in which it does not interfere with the selection element heel 7*b*.

More particularly, a frame 9 is fixed relatively to the lifting cams 6 and supports a plurality of selection levers 8 so that they are slidable in a radial direction with respect to the needle cylinder; said selection levers overlap one another and their ends directed towards the needle cylinder are at different heights so that each end is at the level of one of the selection element heels 7*b* of the selection elements.

Each selection lever is constituted by a flat lamina 10; the end of said lever directed towards the needle cylinder defines a rising portion 10*a* which extends on an inclined plane with respect to the axis of the needle cylinder. The selection element heel 7*b* of the selection element engages with said rising portion 10*a* when the selection lever is in the first position.

Advantageously, said end of the selection lever has, upstream of the rising portion according to the direction of rotation of the needle cylinder, a first portion 10*b* which is contacted by the selection element heels 7*b* of the selection elements arranged at this level so as to move the selection lever from the first position to the second; retention means 11 are provided, which are controllably activatable or deactivatable so as to retain, or not retain, the selection lever in this position.

More particularly, each selection lever 8 can move from the first position to the second position along a radial direction with respect to the needle cylinder, and said retention means 11 are constituted by an electromagnet 12 which is connected to an electronic machine control element 13 and is arranged facing the end of the selection lever, made of ferromagnetic material, which is opposite with respect to the needle cylinder.

Said control element 13 activates the electromagnet 12 or does not activate it according to a preset knitting program.

The movement of the selection lever from the first position to the second position is biased by elastic return means, constituted for example by a spring 14, having one end associated with a selection lever, and another end associated with the frame 9.

To prevent impact with the selection element heel 7*b* of the selection elements, the first portion 10*b* conveniently has a guiding portion 10*c* which is inclined with respect to a radial plane of the needle cylinder and parallel to the axis of said needle cylinder.

Expediently, in order to avoid impact of the selection element heel 7*b* of the selection elements against the rising portion 10*a* of the selection lever, the first portion 10*b* protrudes with respect to the rising portion 10*a* towards the needle cylinder, i.e. as shown in FIGS. 9 and 10, when the lamina 10 of the selection lever 8 is arranged laterally to the needle cylinder 4, the first portion 10*b* is nearer to the cylinder 4 than is the rising portion 10*a*.

To allow the selection element heel 7*b* to engage with the rising portion 10*a*, a recess or missing portion 15 is furthermore defined between said rising portion and the first portion 10*b*.

In order to move the selectors 2 from their inoperative position to the operative position, the upper end 7*c* of each selection element is shaped according to a plane which is inclined with respect to the axis of the needle cylinder, and engages with the lower end of the overlying selector, said end also being shaped according to an inclined plane, so that the lifting of the selection element causes oscillation of the overlying selector, thereby extracting its heel 2*a* from the related groove.

Cams, generally indicated by the reference numeral 16, are arranged around the needle cylinder and actuate the needles 5, which have a heel 5*a*, as well as the selectors 2 and the selection elements 7. The aspect of the invention illustrated merely by way of example in FIG. 3 features a selection element cam 17 in which a recess or missing portion 18 is defined at the selection levers 8. Said recess 18 allows the selection elements 7 to rise and lowers them by means of a descending portion 18*a* arranged downstream of the selection levers 8, wherewith engages an auxiliary heel 7*d* of the selection elements which may be lifted by the selection levers.

The lifting cam 6 is arranged at the selector heel 2*a* of the selectors and has a rising portion 6*a* immediately downstream of the selection levers according to the direction of rotation of the needle cylinder, indicated by an arrow 19. Each selector has a second heel 2*c* which always protrudes from its related groove and engages a descent selector cam 20 having a selector descending portion 20*a* spaced downstream of the rising portion 6*a* of the cam 6. A countercam 21 is arranged between the cam 6 and the cam 20.

A needle cam 22 is arranged at the level of the heels 5*a* of the needles 5 and has a needle descending portion 22*a* downstream of the selector descending portion 20*a* of the selector cam 20.

Figure 3:
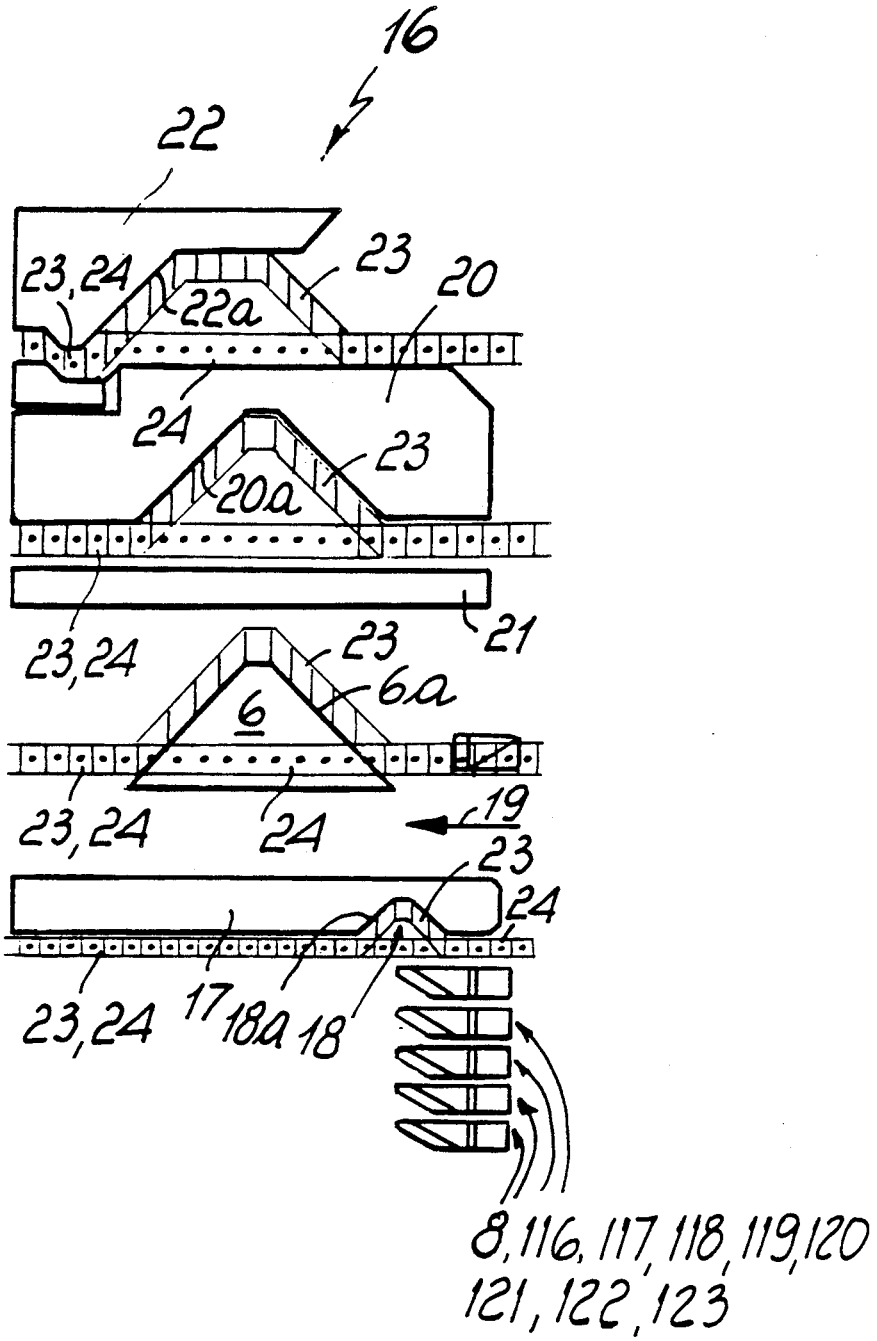
Figure 11:
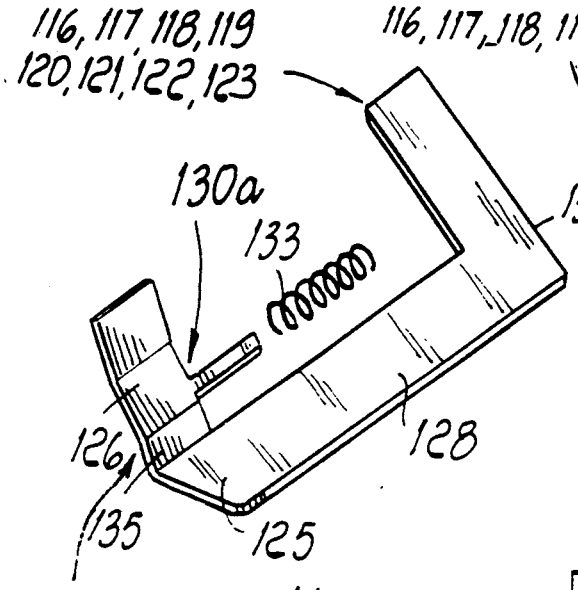
Figure 12:
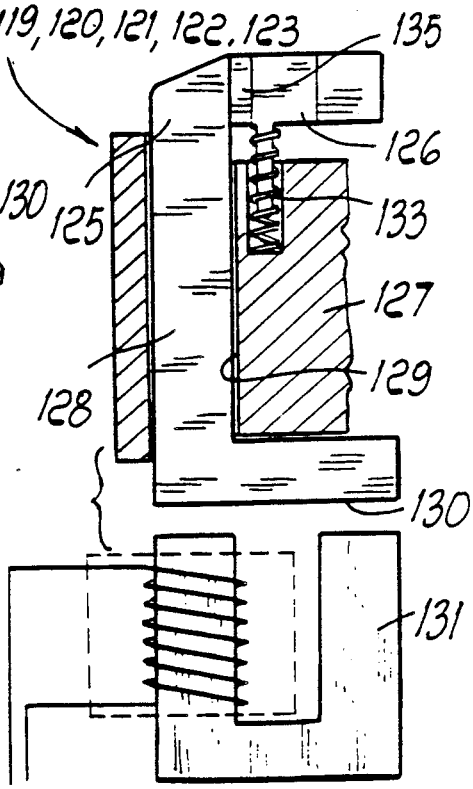
Figure 13:
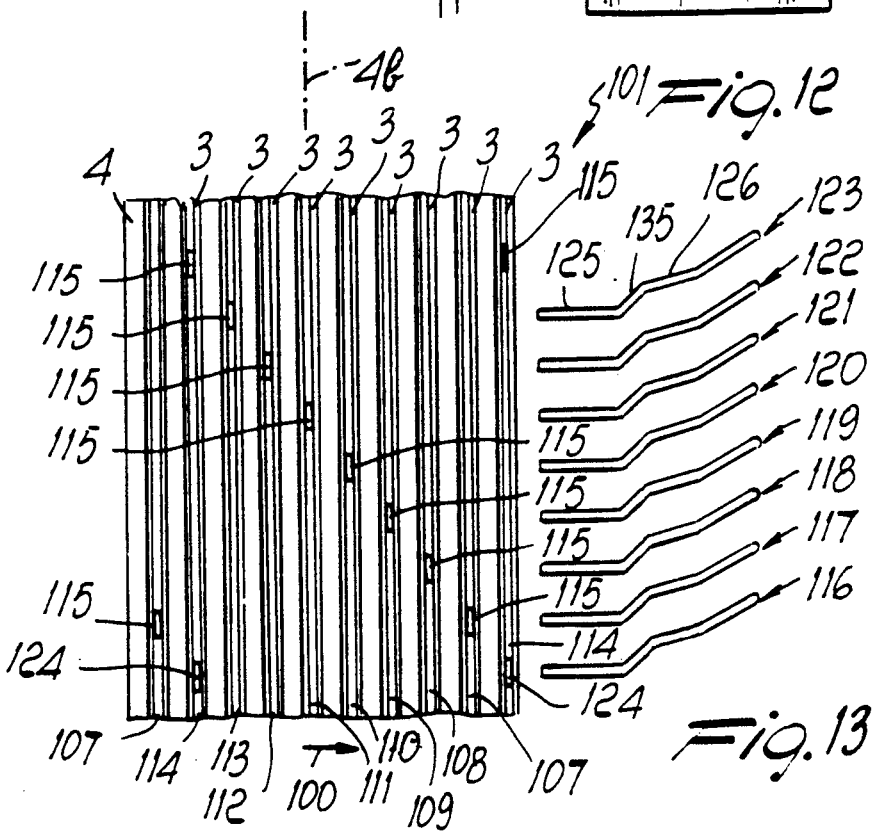

FIG. 3 illustrates the paths of the heels 5*a*, 2*a*, 2*c*, 7*b* and 7*d* of the various elements in a groove 3; respectively, the vertical lines indicate the path 23 followed by the heels when the selection lever 8 corresponding to the heel of the selection element being considered is in the first position, and the dots indicate the path 24 followed by the heels when the selection lever 8 is retained in the second position, as will become apparent hereinafter.

When the needle 5 arranged in a preset groove 3 is to be moved into an operative or knitting position, after the selection element heel 7*b* of the underlying selection element 7 has pushed the corresponding selection lever 8 to its second position by following the first portion 10*b*, the electromagnet 12 is not activated and the selection lever 8 therefore returns to its first position due to the action of the spring 14. The selection element heel 7*b* then passes in the recess 15 and engages with the rising portion 10*a*. The selection element 7 is thus raised and moves the overlying selector 2 to its operative position by acting on it. In this manner, the selector heel 2*a* engages with the rising portion 6*a* and raises the needle 5, causing it to knit. The selection element 7, the selector 2 and the needle 5 are subsequently lowered by the descending portions 18*a*, 20*a* and 22*a*, and the selector heel 2*a* of the selector 2 is inserted into its related groove by a known pusher element arranged upstream the lifting cam 6.

If the needle 5 is to be excluded from knitting, after the heel 7*b* of the underlying selection element 7 has pushed said selection lever 8 to the second position, the electromagnet 12, which has been energized, retains the related selection lever 8. In this manner, the selection element does not engage the rising portion 10*a* and the selector 2 is kept in an inoperative position.

FIGS. 11 to 25 illustrates a second aspect of the selection device according to the invention, which is generally indicated by the reference numeral 101. This is preferred for machines with a large number of needles per unit of length and high operating speeds.

Also, in this aspect of the invention, cams are arranged around the needle cylinder, which are assigned the same reference numerals as in the first embodiment; said cams are engageable with heels of the needles, of the selectors and of the selection elements which are fully similar to the cams previously described for the first embodiment of the device according to the invention.

More particularly, the embodiment illustrated in FIGS. 11 to 25 relates to a circular knitting machine for stockings comprising a plurality of groups of selection elements. Each group is composed of eight mutually adjacent selection elements, each having a heel protruding from the related groove 3 of the needle cylinder 4. The selection element heels 115 of the selection elements of a same group are arranged at different heights with respect to one another in an ascending sequence in the opposite direction with respect to the direction of rotation of the needle cylinder, schematically indicated by the arrow 100 in FIG. 13.

For the sake of clarity in description, the selection elements of a same group have been referenced by different reference numerals in relation to the different heights of their heels; more particularly, they have been indicated by the reference numerals 107 to 114, while the same numeral 115 has been maintained for the selection element heels.

Similarly, again with reference to the illustrated aspect of the invention, there are eight selection levers arranged at different heights and indicated by the reference numerals 116 to 123.

Besides the selection element heel 115, the last selection element 114 has a last selection element heel 124 arranged at a level corresponding to the level of the selection lever 116, as will become apparent hereinafter.

Each selection lever is substantially constituted by a thin plate in ferromagnetic material, which can advantageously be manufactured by precision shearing and is bent at its first end 130*a* to be directed towards the needle cylinder, so as to define a first portion 125 which, when the selection lever is correctly located, is arranged in a substantially, horizontal plane, i.e. a plane perpendicular to the axis of the needle cylinder, as well as a second portion or rising portion 126 which rises starting from the first portion 125.

The selection levers are individually supported so as to be slidable along a radial direction with respect to the needle cylinder bY a supporting frame 127 rigidly associated with the lifting cams 6 and arranged upstream of said cams according to the direction of rotation of the needle cylinder. More particularly, each selection lever has a stem 128 which engages in a sliding seat 129 defined in the supporting frame and extending along a radial direction with respect to the needle cylinder; in this manner, each selection lever is movable along said direction towards or away from the needle cylinder to pass from the first position, in which the first end 130*a* does not interfere with a selection element heel, to the second position, in which the first end 130*a* interferes with the selection element heel of a selection element, and vice versa.

The first portion 125 conveniently defines, on its side directed towards the needle cylinder, a guiding portion which progressively approaches the needle cylinder according to the direction of rotation of the needle cylinder.

As in the previously described aspect of the invention, controllable activatable or deactivatable retention means act on the selection levers to keep the selection levers in the second position More particularly, the second end 130 of each selection lever, located on the opposite side with respect to the needle cylinder, is arranged facing an electromagnet 131 which constitutes said retention means and can be controllably energized or de-energized in a known manner according to a preset knitting program, for example by means of an electronic control element 132 which controls the various operations of the machine.

The retention action of the energized electromagnet overcomes the biasing action of elastic return means constituted by a spring 133 which acts on the selection lever with a force directed towards the needle cylinder so as to return the selection lever to its first position when the electromagnet is de-energized.

The first portion 125 of each selection lever is arranged substantially at the level of the heel of a selection element which is arranged upstream of the selection element to be selected with the selection lever, according to the direction of rotation of the needle cylinder, and the rising portion 126 has a vertical extension which causes a preset lifting of the selection element to be selected when the selection lever is in the first position, as will become apparent hereinafter.

In this manner, during the rotation of the needle cylinder the selection element heel of a selection element which precedes the selection element to be selected acts on the first portion 125, moving the selection lever from the first position to the second position. Depending oh whether the electromagnet 131 is energized or de-energized, the selection lever remains in the second position or is returned to the first position to interact with the selection element heel of the selection element to be selected and lift it.

Advantageously, the selection element having the selection element heel which acts on the first portion 125 of a selection lever is arranged in the groove immediately preceding the groove which accommodates the selection element to be selected with that selection lever.

Advantageously, downstream of the first portion 125 of each selection lever according to the direction of rotation of the needle cylinder there is defined a hold or return recess 134, so as to allow the selection lever to return to its first position despite the presence of the selection element heel of the selection element which acted on the first portion 125.

The rising portion 126 has, on its side directed towards the first portion 125, a rising first portion 135 which is bent so as to be more inclined than the remaining portion, which constitutes the actual rising portion; below the selection lever, said rising first portion 135 defines said return recess 134, so that the selection lever can return to the first position while the selection element heel of the selection element which acted on the first portion 125 passes below the selection lever.

The operation of the selection device according to the second aspect of the invention is as follows.

If a needle 5 of a groove 3, for example the needle overlying the selection element 110, is to be excluded from knitting, the electromagnet 131 is activated, so as to retain the selection lever 119 in the second position, after the selection element heel 115 of said selection element 109 has acted on the first portion 125 of the selection lever 119, pushing it towards the electromagnet 131, as illustrated in FIGS. 14, 17 and, 15 and 18. In this manner, the selection element heel 115 of the selection element 110 does not interact with the selection lever 119 and therefore does not engage with the rising portion 126 (FIGS. 16 and 19). By virtue of this fact, the selection element 110 is not lifted and the overlying selector remains in its inoperative position If the needle 5 arranged above the selection element 110 is to be included in the knitting, the electromagnet 131 is not activated after the selection element heel 115 of the selection element 109 has acted on the first portion 125 of the selection lever 119, moving it from the first position to the second (FIGS. 20 and 23), and the selection lever 119 is returned to its first position by the spring 133. In this manner, the selection element heel 115 of the selection element 110 engages with the rising portion 126 (FIGS. 21 and 24), and is raised so as to act on the overlying selector (FIGS. 22 and 25). As an effect of the lifting of the selection element 110, the overlying selector moves from its inoperative position to its operative position, as already described for the operation of the device in its first embodiment, and its selector heel 2*a* engages with the rising portion 6*a* and lifts the needle 5, moving it to knit The selection element 110, the selector 2 and the needle 5 are subsequently lowered by the descending portions 18*a*, 20*a* and 22*a* of the respective cams, and the selector heel 2*a* of the selector 2 is inserted into its related groove by knoWn pusher element arranged upstream of the lifting cam 6.

From the described operation it is evident that the last selection element heel 124 is not used to lift the selection element 114 but is used instead to move the selection lever 116, which is intended to engage with the selection element heel 115 of the successive selection element 107, from the first position to the second position.

In practice it has been observed that the selection device according to the invention fully achieves the intended aim, as it allows a large number of selections with reduced-length selectors which, as such, have no problems of longitudinal flexing; furthermore, this problem is also absent in the selection elements, since they are not subject to radial movements by the selection levers Another advantage of the device according to the invention, particularly in the second aspect thereof, is that very high actuation speeds of the selection levers can be obtained, and the operating speed of the machine can therefore be increased even in machines having a large number of needles per unit of length while preserving high reliability in selection.

The device thus conceived is susceptible to numerous modifications and variations, all of which are within the scope of the inventive concept; thus, for example, the inclined plane for coupling the selection element and the overlying selector 2 may have an opposite inclination with respect to what is illustrated. In that case, the selection element would act on the overlying selector to move it from its operative position to its inoperative position, and the selector 2 could be kept in operative position in a known manner by an elastic ring arranged around the needle cylinder and acting on the upper end of the selector.

All the details may furthermore be replaced with technically equivalent elements.

In practice, the materials employed, as well as the dimensions, may be any according to the requirements and to the state of the art.

We claim:

1. Needle selection device for circular knitting machines, comprising a needle cylinder having a cylinder axis, an outer cylindrical surface being defined by said needle cylinder, a plurality of grooves being provided in said cylindrical surface and extending parallel to said cylinder axis, a plurality of selectors, each selector of said plurality of selectors being slidably accommodated in one of said plurality of grooves, a plurality of needles, each needle of said plurality of needles being slidably accommodated in one of said plurality of grooves above one of said plurality of selectors thereof, said each selector being provided with at least one selector heel, said at least one selector heel at least temporarily protruding from one of said plurality of grooves, at least one lifting cam being arranged facing said outer cylindrical surface of said needle cylinder, a relative rotation of said needle cylinder relative to said at least one lifting cam being defined, said at least one selector heel being adapted to selectively engage with said at least one lifting cam during said relative rotation to selectively lift said each selector, said each selector being oscillable inside one of said plurality of grooves such that said at least one selector heel moves in a direction substantially perpendicular to said cylinder axis, said each selector being oscillable between an operative position in which said at least one selector heel engages with said at least one lifting cam to thereby lift said each selector which thereby selects a corresponding one of said plurality of needles to knit, and an inoperative position in which said at least one selector heel does not engage with said at least one lifting cam, said needle selection device further comprising actuation means acting on said each selector to oscillate said each selector from said inoperative position to said operative position, said actuation means comprising a plurality of selection elements, each selection element of said plurality of selection elements being slidably accommodated below one of said plurality of selectors in one of said plurality of grooves, said each selection element being provided with at least one selection element heel, said at least one selection element heel protruding from one of said plurality of grooves, said actuation means further comprising at least one selection lever being arranged facing said outer cylindrical surface of said needle cylinder, a relative rotation of said needle cylinder relative to said at least one selection lever being defined and being equal to said relative rotation of said needle cylinder relative to said at least one lifting cam, said at least one selection lever having a first end and a second end, said at least one selection lever being movable towards and away from said outer cylindrical surface from a first position, in which said first end interferes with said at least one selection element heel, to a second position, in which said first end does not interfere with said at least one selection element heel, said first end of said at least one selection lever having a rising portion and a first portion, said first portion being upstream of said rising portion according to a direction of said relative rotation of said needle cylinder relative to said at least one selection lever, said first portion being engageable, when said at least one selection lever is in said first position during said relative rotation, with said at least one selection element heel to thereby move said at least one selection lever from said first position to said second position, retention means being provided for selectively retaining said at least one selection lever in said second position, said rising portion being engageable, when said at least one selection lever is in said first position during said relative rotation, with said at least one selection element heel to thereby upwardly slide in a corresponding one of said plurality of grooves a corresponding one of said plurality of selection elements to thereby oscillate a corresponding one of said plurality of selectors into said operative position.

2. Device according to claim 1, wherein said first end has a return recess between said first portion and said rising portion, said return recess allowing for said at least one selection lever to return to said first position despite a presence at said return recess of said at least one selection element heel which engaged said first portion.

3. Device according to claim 1, wherein a first said at least one selection element heel engages with said first portion of said at least one selection lever and thereafter a second said at least one selection element heel arranged upstream of said first said at least one selection element heel with respect to a direction of said relative rotation of said needle cylinder relative to said at least one selection lever engages with said rising portion of said at least one selection lever when said at least one selection lever is in said first position.

4. Device according to claim 3, wherein a first one of said plurality of selection elements having said first said at least one selection element heel is accommodated in a first one of said plurality of grooves, a second one of said plurality of selection elements having said second said at least one selection element heel is accommodated in a second one of said plurality of grooves, said second one of said plurality of grooves is arranged immediately upstream of said first one of said plurality of grooves according to a direction of rotation of said needle cylinder relative to said at least one selection lever, said second one of said plurality of selection elements is thereby selected to oscillate a corresponding one of said selectors being accommodated in said second one of said plurality of grooves into said operative position.

5. Device according to claim 3, wherein a first one of said plurality of selection elements having said first said at least one selection element heel is accommodated in a first one of said plurality of grooves, a second one of said plurality of selection elements having said second said at least one selection element heel is accommodated in a second one of said plurality of grooves, said second one of said plurality of grooves is arranged immediately upstream of said first one of said plurality of grooves according to a direction of rotation of said needle cylinder relative to said at least one selection lever, said second one of said plurality of selection elements is thereby selected to oscillate a corresponding one of said selectors being accommodated in said second one of said plurality of grooves into said operative position, said first portion of said at least one selection lever is arranged substantially at a level of said first said at least one selection element heel, said rising portion of said at least one selection lever has an extension parallel to said cylinder axis to cause a preset lifting of said second one of said plurality of selection elements.

6. Device according to claim 2, wherein said at least one selection lever is constituted by a reduced-thickness plate sheared and bent at said first end to define said first portion and said rising portion, said return recess is defined by a fold of said reduced-thickness plate between said first portion and said rising portion.

7. Device according to claim 1, wherein said retention means are constituted by an electromagnet engageable with said second end of said at least one selection lever, at least one portion of said at least one selection lever being made of ferromagnetic material.

8. Device according to claim 1, wherein said first portion defines a guiding portion, said guiding portion progressively approaches said needle cylinder according to a direction of rotation of said needle cylinder relative to said at least one selection lever.

9. Device according to claim 1, wherein said at least one selector heel of said each selector protrudes from a respective one of said plurality of grooves when said each selector is in said operative position, said at least one selector heel of said each selector is inserted in a respective one of said plurality of grooves when said each selector is in said inoperative position.

10. Device according to claim 1, wherein said each selection element has an upper end shaped according to a plane which is inclined with respect to said cylinder axis, said upper end being engageable when said each selection element is lifted with a complimentarily shaped lower end of said each selector to oscillate said each selector from said inoperative position to said operative position.

11. Device according to claim 1, wherein each said selection element has an auxiliary heel protruding from a related one of said plurality of grooves, a selection element cam being provided and arranged facing said outer cylindrical surface of said needle cylinder, a relative rotation of said needle cylinder relative to said selection element cam being defined and being equal to said relative rotation of said needle cylinder relative to said at least one lifting cam, said selection element cam defining a descending portion being arranged downstream of said at least one selection lever according to a direction of said relative rotation of said needle cylinder relative to said selection element ca, said auxiliary held engaging with said descending portion during said relative rotation to thereby lower said each selection element.

12. Device according to claim 1, further comprising a frame arranged laterally facing said outer cylindrical surface of said needle cylinder and supporting a plurality of mutually overlapping selection levers identical to said at least one selection lever, said plurality of selection levers being supported by said frame so as to be slidable in a direction substantially perpendicular to said cylinder axis towards and away from said outer cylindrical surface of said needle cylinder, each one of said plurality of selection levers being arranged at a level corresponding to said at least one selection element heel of said each selection element arranged below said each selector in said plurality of grooves.

13. Device according to claim 1, further comprising elastic return means acting on said at least one selection lever to bias said at least one selection lever towards said first position, said at least one selection lever being movable from said first position to said second position by virtue of thrust action of said at least one selection element heel acting on said first portion of said at least one selection lever during said relative rotation.

14. Device according to claim 1, wherein a portion of said at least one selection lever bearing said first portion protrudes towards said needle cylinder with respect to a portion of said at least one selection lever bearing said rising portion.

15. Device according to claim 1, wherein a first said at least one selection element heel engages with said first portion of said at least one selection lever during said relative rotation when said at least one selection lever is in said first position to thereby move said at least one selection lever from said first position to said second position, thereafter said first said at least one selection element heel engages with said rising portion of said at least one selection lever when said at least one selection lever is in said first position.

16. Needle selection device for circular knitting machines, comprising a needle cylinder having a cylinder axis, an outer cylindrical surface being defined by said needle cylinder, a plurality of grooves being provided in said cylindrical surface and extending parallel to said cylinder axis, a plurality of selectors, each selector of said plurality of selectors being slidably accommodated in one of said plurality of grooves, a plurality of needles, each needle of said plurality of needles being slidably accommodated in one of said plurality of grooves above one of said plurality of selectors thereof, said each selector being provided with at least one selector heel, said at least one selector heel at least temporarily protruding from one of said plurality of grooves, at least one lifting cam being arranged facing said outer cylindrical surface of said needle cylinder, a relative rotation of said needle cylinder relative to said at least one lifting cam being defined, said at least selector heel being adapted to selectively engage with said at least one lifting cam during said relative rotation to selectively lift said each selector, said each selector being oscillable inside one of said plurality of grooves such that said at least one selector heel moves in a direction substantially perpendicular to said cylinder axis, said each selector being oscillable between an operative position in which said at least one selector heel engages with said at least one lifting cam to thereby lift said each selector which thereby selects a corresponding one of said plurality of needles to knit, and an inoperative position in which said at least one selector heel does not engage with said at least one lifting cam, said needle selection device further comprising actuation means acting on said each selector to oscillate said each selector from said inoperative position to said operative position, said actuation means comprising a plurality of selection elements, each selection element of said plurality of selection elements being slidably accommodated below one of said plurality of selectors in one of said plurality of grooves, said each selection element being provided with at least one selection element heel, said at least one selection element heel protruding from one of said plurality of grooves, said actuation means further comprising at least one selection lever being arranged facing said outer cylindrical surface of said needle cylinder, a relative rotation of said needle cylinder relative to said at least one selection lever being defined and being equal to said relative rotation of said needle cylinder relative to said at least one lifting cam, said at least one selection lever having a first end and a second end, said at least one selection lever being movable towards and away from said outer cylindrical surface from a first position, in which said first end interferes with said at least one selection element heel, to a second position, in which said first end does not interfere with said at least one selection lever having a rising portion and a first portion, said first portion being upstream of said rising portion according to a direction of said relative rotation of said needle cylinder relative to said at least one selection lever, a first said at least one selection element heel being engageable with said first portion of said at least one selection lever during said relative rotation when said at least one selection lever is in said first position to thereby move said at least one selection lever from said first position to said second position, a second said at least one selection element heel arranged upstream of said first said at least one selection element heel with respect to a direction of said relative rotation of said needle cylinder relative to said at least one selection lever being engageable with said rising portion of said at least one selection lever when said at least one selection lever is in said first position, said rising portion being engageable, when said at least one selection lever is in said first position during said relative rotation, with said at least one selection element heel to thereby upwardly slide in a corresponding one of said plurality of selection elements to thereby oscillate a corresponding one of said plurality of selectors into said operative position.

17. Device according to claim 16, further comprising retention means for selectively retaining said at least one selection lever in said second position.

18. Device according to claim 16, wherein said first end has a return recess between said first portion and said rising portion, said return recess allowing for said at least one selection lever to return to said first position despite a presence at said return recess of said at least one selection element heel which engaged said first portion.

19. Device according to claim 16, wherein a first one of said plurality of selection elements having said first said at least one selection element heel is accommodated in a first one of said plurality of grooves, a second one of said plurality of selection elements having said second said at least one selection element heel is accommodated in a second one of said plurality of grooves, said second one of said plurality of grooves is arranged immediately upstream of said first one of said plurality of grooves according to a direction of said relative rotation of said needle cylinder relative to said at least one selection lever, said second one of said plurality of selection elements is thereby selected to oscillate a corresponding one of said selectors being accommodated in said second one of said plurality of grooves into said operative position.

20. Device according to claim 16, wherein a first one of said plurality of selection elements having said first said at least one selection element heel is accommodated in a first one of said plurality of grooves, a second one of said plurality of selection elements having said second said at least one selection element heel is accommodated in a second one of said plurality of grooves, said second one of said plurality of grooves is arranged immediately upstream of said first one of said plurality of grooves according to a direction of said relative rotation of said needle cylinder relative to said at least one selection lever, said second one of said plurality of selection elements is thereby selected to oscillate a corresponding one of said selectors being accommodated in said second one of said plurality of grooves into said operative position, said first portion of said at least one selection lever is arranged substantially at a level of said first said at least one selection element heel, said rising portion of said at least selection lever causes a preset lifting of said second one of said plurality of selection elements.

21. Device according to claim 18, wherein said at least one selection lever is constituted by a reduced-thickness plate sheared and bent at said first end to define said first portion and said rising portion, said return recess is defined by a fold of said reduced-thickness plate between said first portion and said rising portion.

22. Device according to claim 17, wherein said retention means are constituted by an electromagnet engageable with said second end of said at least one selection lever, at least one portion of said at least one selection lever being made of ferromagnetic material.

23. Device according to claim 16, wherein said first portion defines a guiding portion, said guiding portion progressively approaches said needle cylinder according to a direction of said relative rotation of said needle cylinder relative to said at least one selection lever.

24. Device according to claim 16, wherein said at least one selector heel of said each selector protrudes from a respective one of said plurality of grooves when said each selector is in said operative position, said at least one selector heel of said each selector is inserted in a respective one of said plurality of grooves when said each selector is in said inoperative position.

25. Device according to claim 16, wherein said each selection element has an upper end shaped according to a plane which is inclined with respect to said cylinder axis, said upper end being engageable when said each selection element is lifted with a complimentarily shaped lower end of said each selector to oscillate said each selector from said inoperative position to said operative position.

26. Device according to claim 16, wherein each said selection element has an auxiliary heel protruding from a related one of said plurality of grooves, a selection element cam being provided and being arranged facing said outer cylindrical surface of said needle cylinder, a relative rotation of said needle cylinder relative to said selection element cam being defined and being equal to said relative rotation of said needle cylinder relative to said at least one lifting cam, said selection element cam defining a descending portion being arranged downstream of said at least one selection lever according to a direction of said relative rotation of said needle cylinder relative to said selection element cam said auxiliary heel engaging with said descending portion during said relative rotation to thereby lower said each selection element.

27. Device according to claim 16, further comprising a frame arranged laterally facing said outer cylindrical surface of said needle cylinder and supporting a plurality of mutually overlapping selection levers identical to said at least one selection lever, said plurality of selection levers being supported by said frame so as to be slidable in a direction substantially perpendicular to said cylinder axis towards and away from said outer cylindrical surface of said needle cylinder, each one of said plurality of selection levers being arranged at a level corresponding to said at least one selection element heel of said each selection element arranged below said each selector in said plurality of grooves 28. Device according to claim 16, further comprising elastic return means acting on said at least one selection lever to bias said at least one selection lever towards said first position, said at least one selection lever being movable from said first position to said second position by virtue of thrust action of said at least one selection element heel action on said first portion of said at least one selection lever during said relative rotation.

29. Device according to claim 16, wherein a portion of said at least one selection lever bearing said first portion protrudes towards said needle cylinder with respect to a portion of said at least one selection lever bearing said rising portion.

30. In combination, a needle selection device and a circular knitting machine, said circular knitting machine comprising a needle cylinder, a plurality of needles, at least one cam, and a plurality of jacks, said needle cylinder having an axis, said needle cylinder having a lateral cylindrical surface, a plurality of grooves being defined in said lateral cylindrical surface, each jack of said plurality of jacks being slidably accommodated in one of said plurality of grooves, each needle of said plurality of needles being slidably accommodated above one of said plurality of jacks in one of said plurality of grooves, at least one heel being provided on said each jack, said at least one heel protruding radially, in a direction substantially perpendicular to said axis, from one of said plurality of grooves, said at least one cam being arranged facing said lateral cylindrical surface, a relative rotation of said needle cylinder relative to said at least one lifting cam being defined, said at least one lifting cam engaging with lifting heels of said plurality of jacks during said relative rotation to lift said plurality of jacks in said plurality of grooves which thereby actuated said plurality of needles to knit, said needle selection device comprising at least one selection lever, return means, and retention means, each said at least one selection lever having a first end and a second end, said first end being arranged facing said lateral cylindrical surface of said needle cylinder, a relative rotation of said needle cylinder relative to said at least one selection lever being defined and being equal to said relative rotation of said needle cylinder relative to said at least one lifting cam, said at least one selection lever being movable between a first position, in which said first end engages with said at least one heel, and a second position, in which said first end is positioned away from said at least one heel, said return means acting on said at least one selection lever to bias said at least one selection lever toward said first position, said retention means acting on said at least one selection lever to selectively retain said at least one selection lever in said second position, wherein said first end comprises a first portion and a second portion, said first portion being upstream of said second portion according to a direction of said relative rotation of said needle cylinder relative to said at least one selection lever, said first portion defining a guiding portion, said guiding portion progressively approaching said needle cylinder according to a direction of said relative rotation of said needle cylinder relative to said at least one selection lever, said at least one heel which is arranged at a level corresponding to said guiding portion thereby engaging said guiding portion during said relative rotation when said at least one selection lever is in said first position so as to move said selection lever from said first position to said second position, said second portion defining a rising portion, said rising portion progressively rising downstream in a direction of said relative rotation of said needle cylinder relative to said at least one selection lever, said at least one heel which is arranged at a level corresponding to said rising portion thereby engaging with said rising portion during said relative rotation when said at least one selection lever is in said first position so as to vertically move a corresponding one of said plurality of jacks in one of said plurality of grooves to thereby cause one of said plurality of needles to knit.

31. A combination according to claim 30, wherein said first end has a return recess between said first portion and said rising portion, said return recess allowing for said at least one selection lever to return to said first position despite a presence at said return recess of said at least one selection element heel which engaged said first portion, said at least one selection lever being constituted by a reduced-thickness plate sheared and bent at said first end to define said first portion and said rising portion, said return recess being defined by a fold of said reduced-thickness plate between said first portion and said rising portion.

32. A combination according to claim 30, wherein a first said at least one heel engages with said first portion of said at least one selection lever and thereafter a second said at least one heel arranged upstream of said first said at least one heel according to a direction of said relative rotation of said needle cylinder relative to said at least one selection lever engages with said rising portion of said at least one selection lever when said at least one selection lever is in said first position, and wherein a first jack of said plurality of jacks having said first said ate least one heel is accommodated in a first one of said plurality of grooves, a second jack of said plurality of jacks having said second said at least one heel is accommodated in a second one of said plurality of grooves, said second one of said plurality of grooves is arranged immediately upstream of said first one of said plurality of grooves according to a direction of said relative rotation of said needle cylinder relative to said at least one selection lever.

33. A combination according to claim 30, wherein a first said at least one heel engages with said first portion of said at least one selection lever and thereafter a second said at least one heel arranged upstream of said first said at least one selection element heel according to a direction of said relative rotation of said needle cylinder relative to said at least one selection lever engages with said rising portion of said at least one selection lever when said at least one selection lever is in said first position, and wherein a first said jack of said plurality of jacks having said first said at least one heel is accommodated in a first one of said plurality of grooves, a second jack of said plurality of jacks element having said second said at least one heel is accommodated in a second one of said plurality of grooves, said second one of said plurality of grooves is arranged immediately upstream of said first one of said plurality of grooves according to a direction of said relative rotation of said needle cylinder relative to said at least one selection lever, said first portion of said at least one selection lever being arranged substantially at a level of said first said at least one heel, said rising portion of said at least one selection lever causes a preset lifting of said second jack.

34. A combination according to claim 30, wherein said retention means are constituted by an electromagnet engageable with said second end of said at least one selection lever, at least one portion of said at least one selection lever being made of ferromagnetic material.

35. A combination according to claim 30, wherein said each jack has an auxiliary heel protruding from a related one of said plurality of grooves, a jack descent cam being provided and being arranged facing said lateral cylindrical surface of said needle cylinder, a relative rotation of said needle cylinder relative to said jack descent cam being defined and being equal to said relative rotation of said needle cylinder relative to said at least one lifting cam, said jack descent cam defining a descending portion being arranged downstream of said at least one selection lever according to a direction of said relative rotation of said needle cylinder relative to said selection element cam, said auxiliary heel engaging with said descending portion during said relative rotation to thereby lower said each jack.

36. A combination according to claim 30, further comprising a frame arranged laterally facing said lateral cylindrical surface of said needle cylinder and supporting a plurality of mutually overlapping selection levers identical to said at least one selection lever, said plurality of selection levers being supported by said frame so as to be slidable in a direction substantially perpendicular to said axis towards and away from said lateral cylindrical surface of said needle cylinder, each one of said plurality of selection levers being arranged at a level corresponding to said at least one heel of said each jack arranged in said plurality of grooves.

37. A combination according to claim 30, wherein said return means acts on said at least one selection lever to bias said at least one selection lever towards said first position, said at least one selection lever being movable from said first position to said second position by virtue of thrust action of said at least one heel acting on said first portion of said at least one selection lever during said relative rotation.

38. A combination according to claim 30, wherein a portion of said at least one selection lever bearing said guiding portion protrudes towards said needle cylinder with respect to a portion of said at least one selection lever bearing said rising portion.

39. A combination according to claim 30, wherein a first said at least one selection element heel engages with said first portion of said at least one selection lever during said relative rotation when said at least one selection lever is in said first position to thereby move said at least one selection lever from said first position to said second position, thereby said first said at least one selection element heel engages with said rising portion of said at least one selection lever when said at least one selection lever is in said first position.

40. In combination, a needle selection device and a knitting machine, said knitting machine comprising a needle bed having a needle bed axis, a plurality of needles, at least one cam, and a plurality of jacks, said needle bed having a lateral surface, said lateral surface having a plane of lay being perpendicular to said axis, a plurality of grooves being defined in said lateral surface, each jack of said plurality of jacks being slidably accommodated in one of said plurality of grooves, each needle of said plurality of needles being slidably accommodated in one of said plurality of grooves, said each jack and said each needle being accommodated in one of said plurality of grooves such that said each jack is positioned radially with respect to said axis between said axis and said each needle, at least one heel being provided on said each jack, said at least one heel protruding in a direction substantially parallel to said axis from one of said plurality of grooves, said at least one cam being arranged facing said lateral surface, a relative rotation of said needle bed relative to said at least one cam being defined, said at least one cam engaging with lifting heels of said plurality of jacks to move said plurality of jacks in said plurality of grooves which thereby actuates said plurality of needles to knit, said needle selection device comprising at least one selection lever, return means, and retention means, each said at least one selection lever having a first end and a second end, said first end being arranged facing said lateral surface of said needle bed, a relative rotation of said needle bed relative to said at least one selection lever being defined and being equal to said relative rotation of said needle bed relative to said at least one cam, said at least one selection lever being movable between a first position, in which said first end engages with said at least one heel, and a second position, in which said first end is positioned away from said at least one heel, said return means acting on said at least one selection lever to bias said at least one selection lever toward said first position, said retention means acting on said at least one selection lever to selectively retain said at least one selection lever in said second position, wherein said first end comprises a first portion and a second portion, said first portion being upstream of said second portion according to a direction of said relative rotation of said needle bed relative to said at least one selection lever, said first portion defining a guiding portion, said guiding portion progressively approaching said needle bed according to a direction of said relative rotation of said needle bed relative to said at least one selection lever, said at least one heel which is arranged at a level corresponding to said guiding portion thereby engaging with said guiding portion during said relative rotation when said at least one selection lever is in said first position so as to move said selection lever from said first position to said second position, said second portion defining a rising portion, said rising portion progressively rising downstream in a direction of said relative rotation of said needle bed relative to said at least one selection lever, said at least one heel which is arranged at a level corresponding to said rising portion thereby engaging with said rising portion during said relative rotation when said at least one selection lever is in said first position so as to radially move outwardly a corresponding one of said plurality of jacks in one of said plurality of grooves to thereby cause one of said plurality of needles to knit.

* * * * *